United States Patent [19]

Lawrence et al.

[11] 3,980,429

[45]*Sept. 14, 1976

[54] CONTINUOUS PROCESS FOR THE LIQUID AMMONIA TREATMENT OF FABRICS

[75] Inventors: Jackson Lawrence, West Sand Lake; Walter S. Troope, Latham, both of N.Y.

[73] Assignee: Cluett, Peabody & Co., Inc., New York, N.Y.

[ * ] Notice: The portion of the term of this patent subsequent to Oct. 28, 1992, has been disclaimed.

[22] Filed: May 14, 1975

[21] Appl. No.: 577,613

Related U.S. Application Data

[60] Continuation-in-part of Ser. Nos. 249,736, May 2, 1972, abandoned, and Ser. No. 346,007, March 29, 1973, and Ser. No. 379,652, July 16, 1973, Pat. No. 3,915,632, said Ser. No. 249,736, and Ser. No. 346,007, each is a division of Ser. No. 106,514, Jan. 14, 1973, abandoned, said Ser. No. 379,652, is a continuation-in-part of said Ser. No. 106,514.

[52] U.S. Cl. ..... 8/125; 8/149.1; 8/149.2; 8/158

[51] Int. Cl.[2] ..... D06M 1/10

[58] Field of Search ..... 8/125, 149.1

[56] References Cited

UNITED STATES PATENTS

| | | | |
|---|---|---|---|
| 3,664,158 | 5/1972 | Skaathun et al. | 68/5 D |
| 3,767,359 | 10/1973 | Calamari et al. | 8/125 |
| 3,849,067 | 11/1974 | Calamari et al. | 8/125 |
| 3,915,632 | 10/1975 | Troope et al. | 8/125 |

*Primary Examiner*—John Kight, III

[57] ABSTRACT

The disclosure relates to a continuous process for the treatment, with liquid ammonia, of moving webs of fabric, the fabric having at least a partial content of natural or regenerated cellulose fiber. Fabric in substantially continuous web form is guided into a treatment chamber and there impregnated with liquid ammonia, desirably by immersion in a bath thereof. The advantageous effects of the liquid ammonia reaction are substantially realized, while undesirable excessive shrinkage of the fabric is avoided, by strictly limiting the time within which liquid ammonia reactions may occur and controllably terminating the reaction at the end of the controlled period. In the process of the invention, the liquid ammonia reaction period commences when the fabric is first introduced into the bath of liquid ammonia and is controllably terminated by bringing the ammonia-saturated web of fabric into contact with a heated drum. As a significant feature of this invention, the reaction period for a fully saturated fabric web is controlled to have a duration of between 0.6 and 9 seconds.

Pursuant to one aspect of the invention, a fabric web is conveyed through a processing zone under controlled lengthwise or warp-direction tension, while substantially free of tension in the width or filling direction. The precise duration of the liquid ammonia reaction period, within the specified overall range of 0.6 to 9 seconds, is controlled to achieve a desired level of residual shrinkage of the fabric in the filling direction. Residual shrinkage of the fabric in the warp-direction is controlled to desired levels by desired control of the lengthwise tension of the fabric. After termination of the reacting period, the fabric web is exposed to further processing, including continued heating and, in most cases, steaming, to rid the fabric of interstitial ammonia and to effect release of the ammonia-cellulose bonds.

The process of the invention enables a fabric to be processed rapidly and economically, to achieve many desirable effects of mercerization, while at the same time maintaining ammonia-induced shrinkage of the fabric.

26 Claims, 11 Drawing Figures

Duration of Liquid-Ammonia Treatment and Shrinkage Relations; 100% Cotton Fabric; Warp Direction at Various Tensions.

Duration of Liquid-Ammonia Treatment and Shrinkage Relations; 100% Cotton Fabric; Fill Direction at Various Tensions.

Duration of Liquid-Ammonia Treatment and Barium Activity Number Relations; 100% Cotton Fabric.

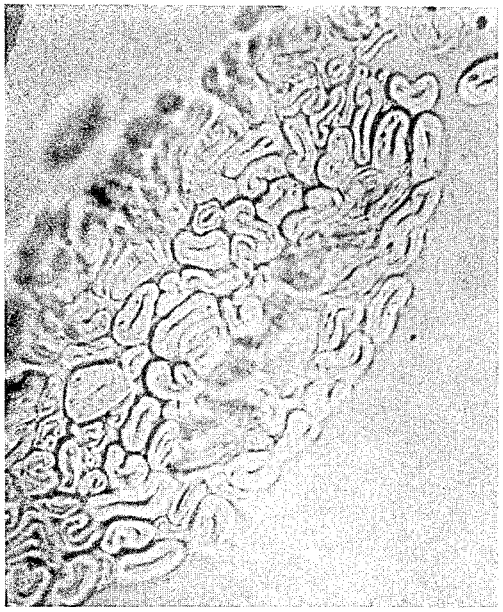
FIG. 7 Untreated
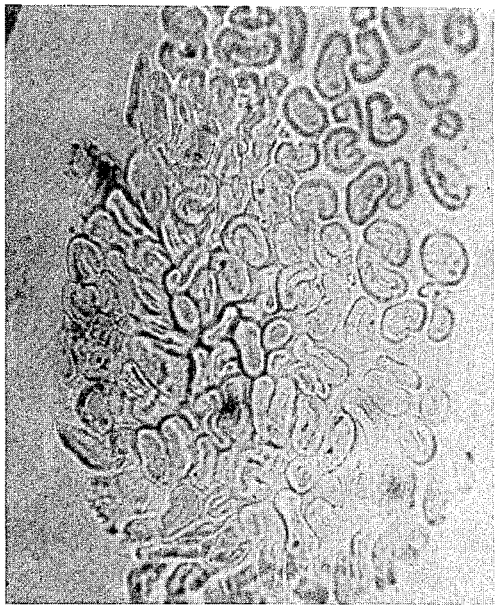
FIG. 8 Treated for One Second
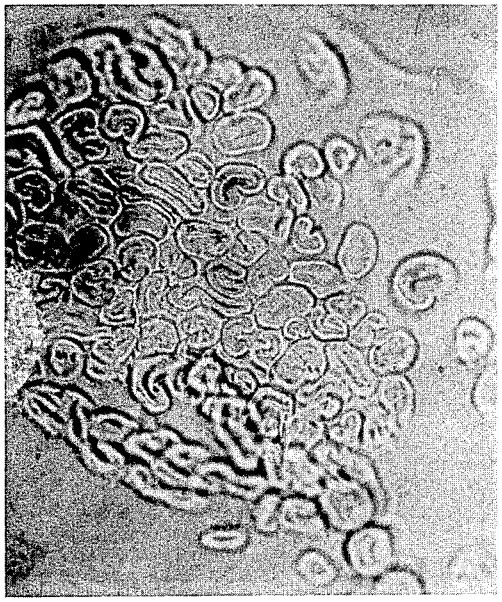
FIG. 9 Treated for Five Seconds
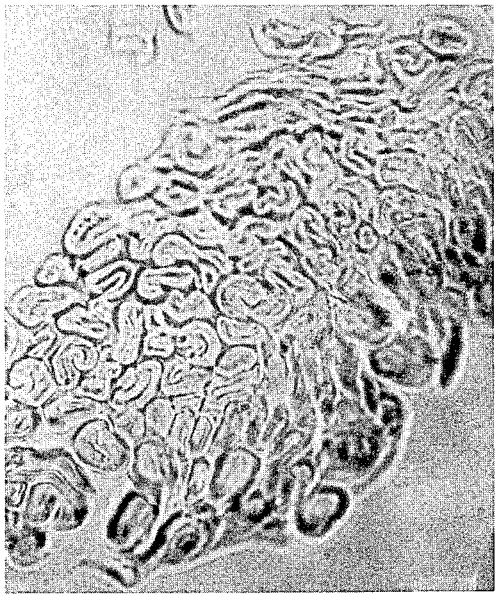
FIG. 10 Treated for Thirty Seconds

CONTINUOUS PROCESS FOR THE LIQUID AMMONIA TREATMENT OF FABRICS

RELATED APPLICATIONS

This application is a continuation-in-part of our copending applications Ser. Nos. 249,736, filed May 2, 1972, now abandoned and Ser. No. 346,007, filed Mar. 29, 1973, the before mentioned copending applications in turn being divisions of our now-abandoned earlier application Ser. No. 106,514, filed Jan. 14, 1971. The present application is also a continuation-in-part of our copending application Ser. No. 379,652, filed July 16, 1973, now U.S. Pat. No. 3,915,632, said last mentioned application being a continuation-in-part of our before mentioned application Ser. No. 106,514. This application is also related to our copending application Ser. No. 393,604, filed Aug. 31, 1973, now abandoned and to the application of Jackson Lawrence, Ser. No. 490,202, filed July 19, 1974, now abandoned.

BACKGROUND OF INVENTION AND PRIOR ART OF INTEREST

The treatment of cellulose-containing fabrics with liquid ammonia has been known for a long period of time. For example, mercerization of cellulosic textile materials with liquid ammonia forms the subject matter of British Pat. No. 374,791 having a priority date (Germany) of Apr. 1, 1931. Since that time, a variety of patents and publications, many of which are identified herein below, have described various processes and techniques for the treatment of fabrics, yarn, and threads with liquid ammonia for various purposes.

Notwithstanding the substantial development effort which has taken place over the years, liquid ammonia processing has not had any significant commercial success in connection with the mercerizing or other finishing treatment of fabrics. Primarily, this has been due to the enormous amount of shrinkage which is induced in the fabric by reaction with the liquid ammonia processing fluid. Notwithstanding the other desirable effects achieved by the liquid ammonia reaction, the "loss" of yardage in the treating process has been so great as to substantially preclude the practical use of liquid ammonia processing in commercial finishing lines.

Significant advancement in techniques of liquid ammonia processing is reflected in the Lindberg et al. U.S. Pat. No. 3,406,006, for example, in which working relationships are sought to be established between application of controlled tension to the fabric, in relation to the amount of processing time, as a means of avoiding excessive shrinkage. However, this approach has important limitations in the context of a commercial finishing line, in which fabric is being processed continuously in web form. The application of tension in the width or filling direction, to a continuously moving web of fabric, is fraught with difficulty and complications. Thus, the invention of the Lindberg et al. patent, while constituting an interesting and significant advance, has not resulted in widespread commercial utilization of liquid ammonia processing techniques, because of the attendant problems in controlling shrinkage loss.

Other patents and publications of interest, dealing with liquid ammonia processing of fabrics, are as follows: Mahn U.S. Pat. No. 1,998,551, Estes U.S. Pat. No. 3,347,963, Webb U.S. Pat. No. 3,511,591, Gailey U.S. Pat No. 3,560,140, Troope et al. U.S. Pat. No. 3,589,030, Skaathun et al. U.S. Pat. No. 3,664,158, Calamari, Jr. et al. U.S. Pat. No. 3,724,243, Calamari, Jr. et al. U.S. Pat. No. 3,767,359, Calamari, Jr. et al. U.S. Pat. No. 3,849,067. Gogek Canadian Pat. No. 810,572. Great Britain Pat. No. 841,401. "Effect of Preswelling on Durable-Press Performance of Cotton", Textile Research Journal, June 1969, pp. 543–7.

SUMMARY OF THE INVENTION

The present invention is based upon the discovery that the advantageous effects of liquid ammonia processing of a cellulose-based fabric may be achieved in a commercially practicable process, without suffering the normally attendant disadvantages, by positively limiting the time period provided for the liquid ammonia reaction to an extremely short time of between 0.6 and 9 seconds. In this connection, we have discovered that the reaction of liquid ammonia with cellulosic containing fabrics proceeds largely as if in two phases. While there is overlap in these phases, they occur to a large extent in a time sequence. In the initial phase, the cellulosic fibers are caused rapidly to swell and become more accessible chemically. In the second phase, the fabric continues to shrink but with little additional fiber swelling. We have established that the mercerizing effects of the liquid ammonia treatment, which result in increased swelling and accessibility, are achieved with extreme rapidity, sometimes within a fraction of a second and in most cases within a period of less than three seconds. Thereafter, shrinkage of the fabric is experienced on a progressive, time-related basis. Some additional fiber swelling may occur during the second phase, but this proceeds at a slower rate than in the first phase. Moreover, the degree of swelling achieved in the first phase typically is amply sufficient to constitute an acceptable level of mercerization according to industry standards.

In the process of the invention, depending upon the requirements of the processor, the fabric may be treated to achieve primarily mercerization effects, or the processing may be extended to provide controlled shrinkage. In either case, the duration of the period in which the liquid ammonia is permitted to react significantly upon the fibers is strictly controlled and limited to a period under nine seconds, usually substantially under nine seconds. In this respect, it is to be understood that the specific treatment accorded to different fabrics may vary rather widely, within the indicated control reaction period of 0.6 to 9 seconds. Some fabrics, with an open construction and a relatively low weight per unit of area, may react at a high rate of speed and may be effectively processed in the lower end of the processing time range. Other fabrics, of heavy, close-woven construction, for example, may require near maximum treatment times, within the controlled period, to achieve the desired effects. The specific processing times applicable to any specific fabric, to achieve a specific end result, have to be determined empirically. Nevertheless, in each case the basic principle of the invention is applicable, that of positively limiting the duration of the reaction period and thereby to control and limit the second or shrinkage phase of the reaction.

In the treatment of fabric web material in a practical commercial processing line, the fabric is treated in a continuous or substantially continuous fashion. Thus, web material may be supplied from relatively large rolls thereof, and the processing is continuous at least for the individual rolls of fabric. Successive rolls may be connected end to end, so that the tail end of a first roll draws the leading end of a successive roll through the processing sequence for greater continuity of processing. Insofar as this application is concerned, the term "continuous" is intended to include the continuous processing of either single or successive batches of web material, whether in roll form, folded batches or otherwise. The term "continuous" is generally intended to exclude, however, the processing of small fabric sections, such as individual garments or individual garment sections, for example, except insofar as such small fabric sections may be connected together in a continuous string or web for processing purposes.

In the continuous processing of a fabric web according to the invention, the web is, out of practical necessity, maintained under at least a minimum warp-wise tension, in order to be able to draw the fabric continuously and under control through the processing chamber. In the width direction, however, the application of tension is difficult to apply and control, and thus the invention contemplates processing the web material in the absence of such width-wise tension. On the other hand, the process of the invention should not be construed to require the absence of width-wise tension, but rather to eliminate the necessity for it.

In the new process, a web of fabric, in substantially dry form is conveyed into a processing chamber and there conveyed into and through a bath of substantially anhydrous liquid ammonia. Desirably, the process is carried out at or slightly below atmospheric pressure, in which case the liquid ammonia is maintained at a temperature of around minus 33° C. After momentary immersion, the web of fabric is passed through a padding nip, to assure thorough impregnation of the fabric by the processing liquid, and the fabric is then conveyed through a controlled path into contact with a heated dryer drum. The dryer drum is maintained at a substantially elevated temperature, such that the cold liquid ammonia is caused to quickly flash off, rapidly terminating the reacting of the liquid ammonia with the cellulosic fibers of the fabric. Although a considerably greater period of time may be required to remove all of the interstitial ammonia and the ammonia-cellulose bonds, it is believed that the shrinkage reaction is terminated almost instantly (e.g., within a small fraction of a second) after the fabric is brought into contact with the heated dryer roll. Thus, for the purposes of this application, the reaction period is deemed to commence when the fabric web enters the liquid ammonia and to terminate when the fabric contacts the heated roll. Precise control over the ammonia reaction is, according to the invention, effected by variably controlling (within the limits of 0.6 to 9 seconds) the time interval between immersion of the fabric and contact thereof with the heated roll and, to greatest advantage, this is accomplished by varying in a controllable manner the length of the path to which the fabric is guided in travelling from the immersion vessel to the dryer drum.

Where controlled preshrinkage is an objective of the treatment, the reaction time is controlled to achieve the desired degree of shrinkage in the width direction, with the fabric substantially in a tension-free state in the filling direction. Typically, shrinkage in the length direction tends to proceed at a much greater rate during the reaction period, and the process of the invention contemplates applying controlled tension to the fabric in the lengthwise direction, as a means of limiting the lengthwise shrinkage to a desired level during the tension-free shrinkage of the fabric in the width direction.

For a more complete understanding of the above and other features and advantages of the invention, reference should be made to the following detailed description and to the accompanying drawing.

DESCRIPTION OF THE DRAWINGS

FIG. 4 reflecting shrinkage in the warp-direction and FIG. 5 reflecting shrinkage in the filling direction.

FIGS. 7–10 are highly magnified photographic cross sectional views of treated and untreated cotton yarn, illustrating the effects of treatment with anhydrous liquid ammonia.

DESCRIPTION OF PREFERRED EMBODIMENTS OF THE INVENTION

In the processing of cellulosic-based fabrics or yarns (i.e., constructed entirely or in part of natural or regenerated cellulose) one or more of a combination of processing results may be sought. Thus, the reaction of cellulosic fibers with liquid ammonia causes the fibers to swell radially and become more porous. This imparts to the fiber or fabric an improved affinity for many finishing agents, such as dyes, flame retardants, resins and the like. These are mercerizing effects, which are frequently desired in the fabric finishing procedure. In addition to mercerizing, liquid ammonia processing of cellulosic fabrics results in a strong tendency toward lengthwise shrinkage of the fabric. In the past, this shrinkage tendency has limited the usefulness of liquid ammonia processing in commercial operations, because of excessive loss of fabric through shrinkage in area. However, pursuant to the invention, if the reaction time of the liquid ammonia on the fabric is strictly limited, the desirable mercerizing effects are achieved, without the accompanying shrinkage. This is reflected in the photomicrographs of FIGS. 7–10 and the graphs of FIGS. 4–6. The photomicrographs of FIGS. 7–10 were taken from random yarns selected from a sample of cotton fabric, hereinafter identified more specifically in connection with Example I. The selected yarns, after treatment, were mounted and then sliced into thin wafers in a plane normal to the fiber axes. The photomicrographs were taken at 500 magnifications, using light transmitted through the samples.

In the photomicrograph of FIG. 7, an untreated control fabric is shown, which reveals the typical bean-like shape of the representative fiber. The photomicrograph of FIG. 8 shows a sample which has been exposed to a 1 second reaction period with liquid ammonia. This shows a number of fibers on the outer surface of the yarn to be already swollen. In FIG. 9, the photomicrograph illustrates the yarn after a reaction period of five seconds, showing a substantial increase in the number of swollen fibers. The photomicrographs of FIG. 10, showing a yarn exposed to a reaction period of 30 seconds, reflects continued swelling of the fibers, but it is evident that the additional swelling reflected between, for example, FIGS. 9 and 10, is not in proportion to the additional time.

Figure 6:
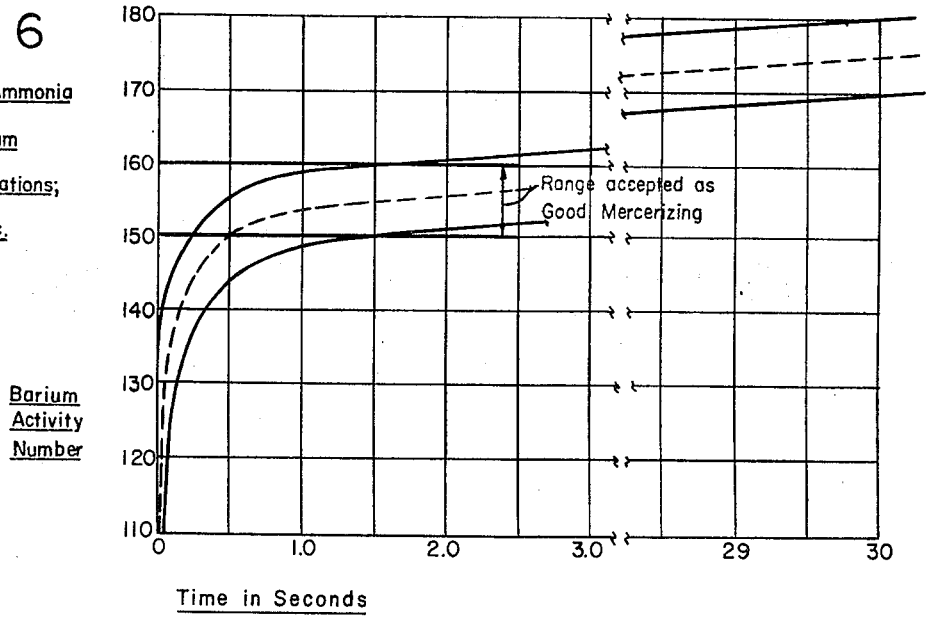
FIG. 6 is a graphic representation reflecting mercerization effectiveness in relation to treatment time, for the processing of a 100% cotton fabric with anhydrous liquid ammonia.

With reference now to FIG. 6, a standard industry test for effectiveness in mercerizing is covered by test procedure AATCC 89-1958T. The test is based on the fact that mercerized cotton absorbs more barium hydroxide than does untreated cotton. Thus, the amount of barium hydroxide absorbed by the sample, in relation to an untreated control, provides a basis for calculating a so-called barium activity number. Pursuant to this test, a barium activity number of around 100 to 105 would indicate substantially no mercerization, while a number above 150 would indicate substantially complete mercerization. Typically, a barium activity number in the range of 150 to 160 would be considered by the trade to reflect effective mercerization. Thus, the graph of FIG. 6 reflects an envelope of data taken on 100% cotton fabric samples (according to Example I) treated with liquid ammonia for various time periods ranging from zero to 3.0 seconds of reaction time as herein defined. As reflected in the graph of FIG. 6, an adequate level of mercerization for commercial finishing purposes is achieved within a reaction period of very short duration. In the initial stage of the reaction period, the slope of the barium activity curve is extremely steep, so that a barium activity level of 150 is achieved in a reaction period of less than 1 second. Thereafter, the barium activity curve increases along a relatively shallow slope, during a second phase of the reaction period.

Figure 5:
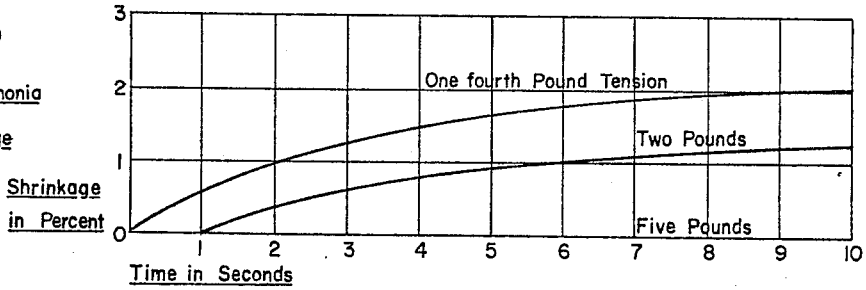

Now, with reference to FIG. 5, the cotton fabric of Example I, when exposed to the liquid ammonia reaction under various levels of width tension. The fabric used in the test of Example I was a 100% cotton broadcloth weighing 3.5 ounces per square yard and having 136 threads per inch in the warp and 64 threads per inch in the filling. The yarn count of the fabric was: warp, 40 singles; filling, 28 singles. Potential shrinkage of the untreated fabric by test method AATCC-135 was: warp, 11.0%; filling, 0.9%. Potential shrinkage by test method CCC-T-191*a* was: warp, 8.5% filling, 2.1%. The graph of FIG. 5 shows that, at five pounds of width tension, little or no width shrinkage occurs in a 10 second reaction period. With 2 pounds per lineal inch of width tension applied, some shrinkage commenced after one second, and shrinkage continued progressively throughout the 10 second period. With one-fourth pound tension, shrinkage commenced immediately, and after ten seconds almost the entire potential shrinkage of two percent had occurred. By extrapolation, shrinkage with a zero width tension would be expected to be slightly greater than indicated for one-fourth pound of tension.

Pursuant to the invention, since effective mercerization of the fabric sample of Example T is complete in less than a second, fabric width shrinkage can be readily held to less than the maximum potential shrinkage of the fabric, even in the absence of width tension, by terminating the ammonia reaction at an appropriate time after completion of the initial phase of the reaction period and within the 9 seconds maximum period contemplated by the invention.

Figure 4:
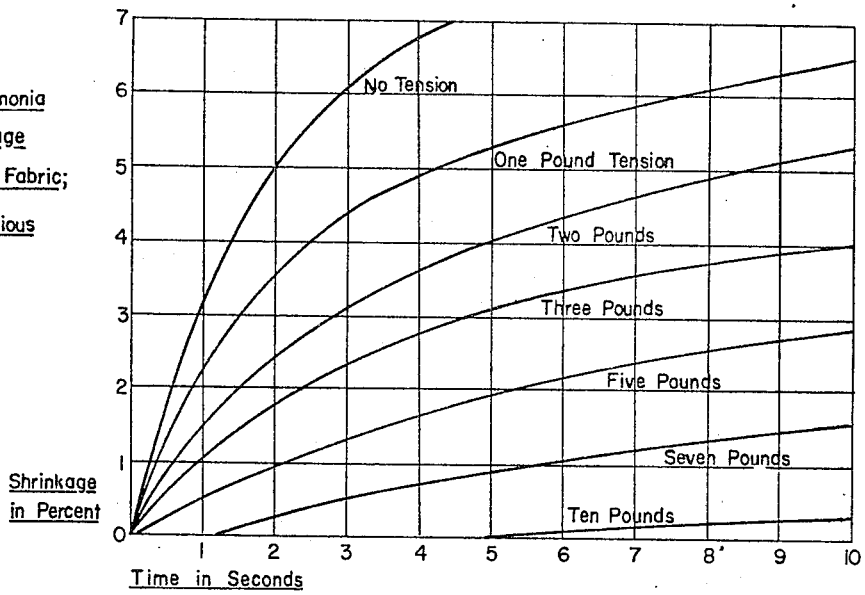
FIGS. 4 and 5 are time-tension graphs illustrating typical shrinkage reaction of a 100% cotton fabric treated with anhydrous liquid ammonia.

Referring now to FIG. 4, a family of curves reflects the shrinkage in percent of the fabric sample of Example I for various times under various amounts of lengthwise tension stated in pounds per lineal inch. For example, if the reaction period provided for is 4 seconds, lengthwise shrinkage of the fabric may be held to under three percent, if that is desirable, by maintaining the fabric under a warp-direction tension of three pounds per lineal inch during the reaction period.

According to one aspect of the invention, the duration of the reaction period is determined by the desired or tolerable degree of widthwise shrinkage to be realized, under substantially no-tension conditions. This will establish the time of the reaction period. With the reaction period this fixed in duration, the desired or tolerable amount of warpwise shrinkage is determined, and an appropriate amount of warpwise processing tension is applied to the fabric during the reaction such that the calculated percentage of warpwise shrinkage results during the indicated reaction period. Typically, the fabric finisher will have predetermined shrinkage tolerances which he seeks to achieve (i.e., a certain amount of residual washing shrinkage usually is tolerated) and these processing conditions usually may be readily achieved by working within the parameters of the new process.

Figure 1:
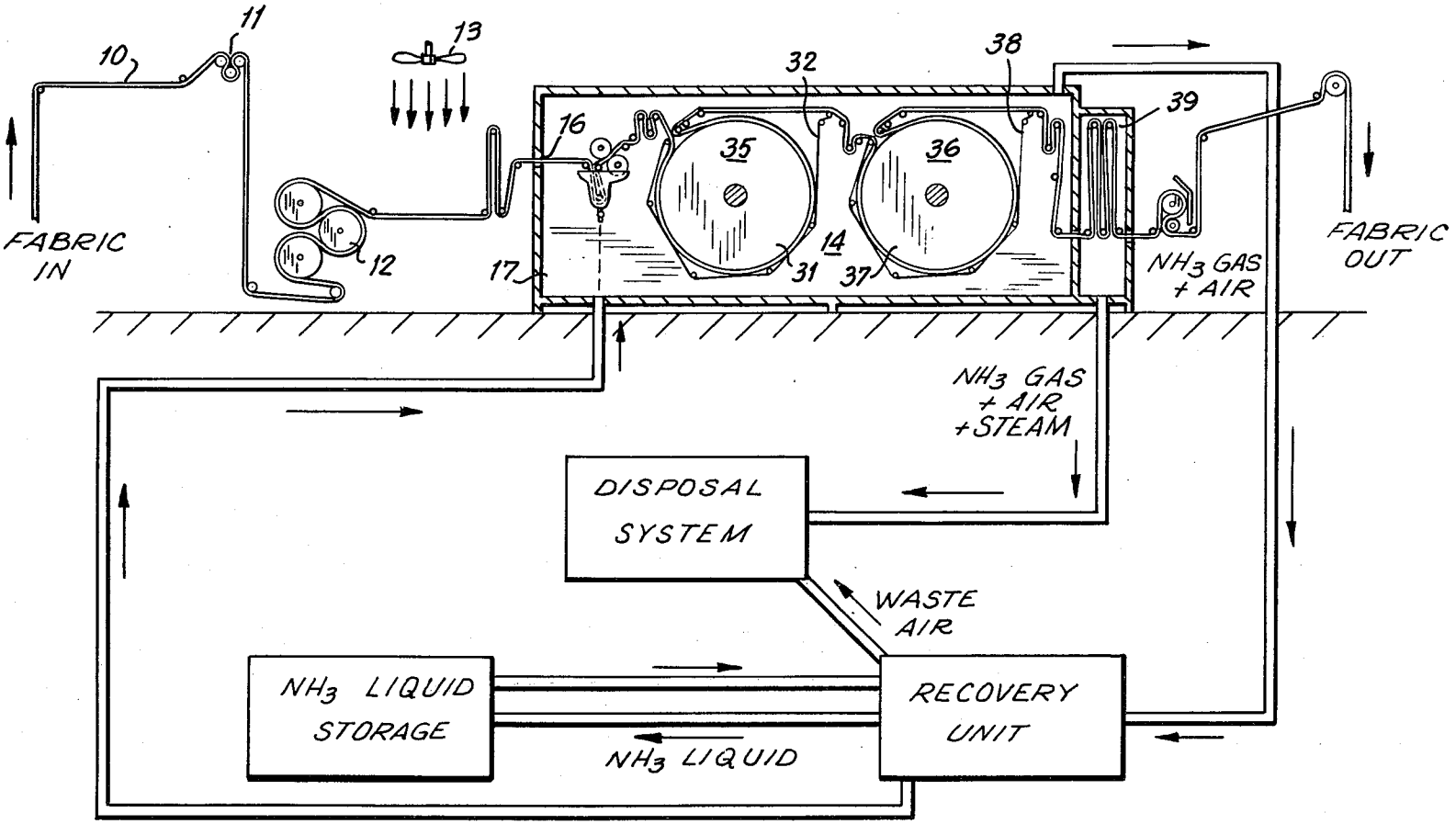
FIG. 1 is a highly simplified, schematic representation of a processing line suitable for carrying out the process of the invention.
Figure 11:
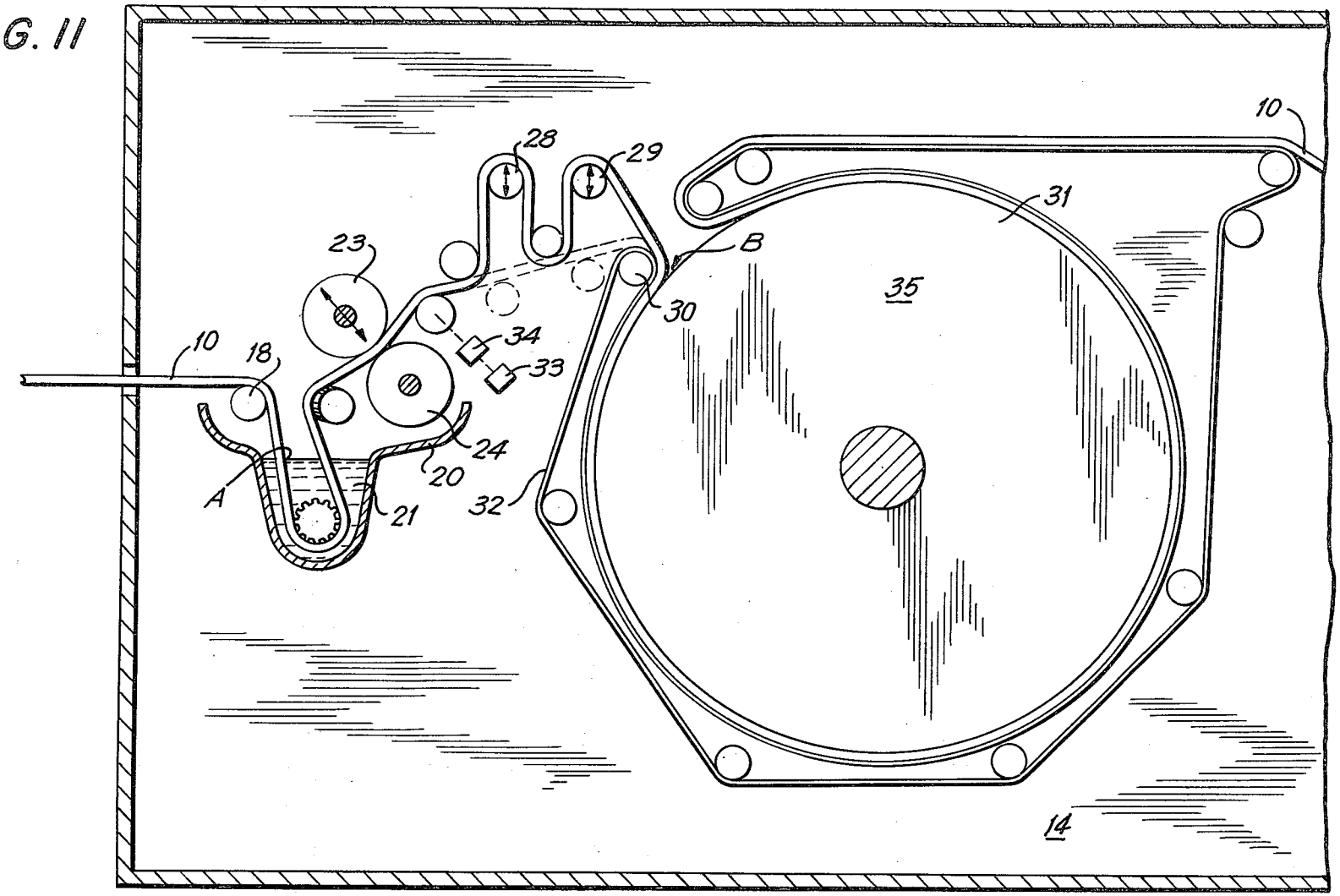
FIG. 11 is an enlarged, schematic representation of a portion of the processing system shown in FIG. 1, illustrating the manner in which processing time and warp-direction tension is controlled pursuant to the invention.

With reference now to FIGS. 1 and 11, there is illustrated schematically a typical processing line for carrying out the method of invention. In FIG. 1, the untreated fabric 10, taken from a roll or other batch supply (not shown) and in substantially dry condition, is passed over smoothing rolls 11 and then around a plurality of heated dry cans 12. The dry cans are considered desirable in a commercial line, in assuring an adequate level of dryness in the fabric and, of more general significance, assuring greater uniformity of moisture content. In this respect, the liquid ammonia reactions optimally require a water content of less than 10 percent in the ammonia at the time of reaction. Since the ammonia absorption of the fabric typically may be 100% of its dry weight, the moisture content of the fabric should in no instance be more than 10 percent, and desirably the fabric moisture level should be well below that in order that the process can tolerate some content of water in the immersion bath. Thus, the dry can 12 serve to assure that the moisture content of the fabric is well below 10 percent and, assuming that the incoming fabric from the supply is in the first instance well below ten percent, the dry cans will tend to assure greater uniformity in moisture content from point to point on the web and thus greater uniformity in the processing itself.

Desirably, after passing over the dry cans 12, the fabric is cooled by a fan 13 prior to entering the processing chamber 14. The cooled fabric passes over smoothing rollers 15, which also serve to pre-tension the fabric somewhat, and the fabric then passes through a gas lock 16 into the interior of processing chamber 14. The interior 17 of the chamber typically is maintained at a slightly negative (e.g., one-half inch of water) pressure, in order to minimize the escape of ammonia gas, and the gas lock 16 typically may be a two-stage lock, the interior which is maintained under an even slightly more negative pressure, so as to avoid leakage of air into the interior of the treating chamber. Such gas locks are well known, and an advantageous form thereof is shown, for example, in the copending application Ser. No. 490,199 of Jackson Lawrence, filed July 19, 1974.

After entering the treatment chamber, the fabric 10 passes over a guide roller 18 (see FIG. 11) and is directed downward and around an immersion roll 19. The immersion roll is disposed in the lower portion of a liquid pan 20, which retains a body of anhydrous liquid ammonia 21. The liquid ammonia bath 21 typically is at a temperature of minus 33° C. and, pursuant to the process, is maintained to have a minimum water content under (and preferably well under) 10 percent by weight. The fabric 10, after passing around the guide roll 18, downward into the liquid ammonia bath, and around the immersion roll 19, is directed upward through the bath and about a further guide roller 22.

In a typical commercial processing operation, the fabric web 10 is advancing at a rate such that its immersion in the liquid ammonia bath 21 may be for a duration of only a fraction of a second. In this connection, however, while the reaction period as defined herein commences with the entry of the fabric web 10 into the liquid ammonia bath, it does not terminate with the removal of the web from the bath, inasmuch as the web remains saturated with liquid ammonia after leaving the bath. In the steady-state condition of the processing chamber 14, the atmosphere within the chamber is saturated with ammonia vapor, such that the liquid ammonia does not tend to evaporate readily from the impregnated fabric emerging from the bath 21.

As reflected in FIG. 11, the impregnated fabric passes around the guide roller 22 and is directed into a pair of resiliently surfaced pad rollers 23, 24, which are mounted to apply adjustable rolling pressure to the fabric. The pad rollers 23, 24 serve two purposes: one, to express from the fabric excess amounts of the liquid ammonia; two, to assure that the fabric is thoroughly penetrated by the liquid ammonia, so that the reaction proceeds uniformly. Desirably, the guide roll 22 is a bowed roller, which serves to smooth and flatten the fabric in a widthwise direction before it enters the pad rollers. In this connection, however, while the bowed roller 22 may momentarily apply a slight widthwise tension to the fabric, it will be appreciated that a bowed roller cannot apply sustained widthwise tension to the fabric to oppose any significant tendency for the fabric to shrink in the width during the reaction period. Thus, the bowed roller 22 (more than one may be utilized, if desired) serves primarily a smoothing function rather than a width tensioning function.

In a processing sequence according to the invention, the fabric 10 emerging on the exit side of the pad roller nip may contain an amount of liquid ammonia ranging from around 20% to around 300% of the weight of the fabric, depending upon factors such as characteristics of the fabric, fabric speed, efficiency of removal, etc. At this time (and as soon as the fabric first enters the ammonia bath 21) the fabric is being reacted upon by the liquid ammonia and is in the "reaction period" as defined herein. During this reaction period, and conveniently after having passed through the pad rollers 23, 24, the fabric passes over a tension control roller 25. By appropriate actuator means 33 which are well known in the trade and need not be illustrated in detail herein, the tension control roller 25 can be controllably urged toward or away from the plane of the fabric web, to impart a desired amount of warpwise tension thereto.

After passing over the tension control roller 25, the fabric passes under fixed axis guide rollers 26, 27 and over movable axis guide rollers 28, 29. Thereafter, the fabric passes around a guide roller 30 and is brought into intimate pressure contact with the surface of a heated dryer drum 31 of a so-called Palmer dryer or similar facility. The dryer includes a confining blanket 32, which is maintained under tension and serves to both press the fabric tightly against the surface of the heated drum 31 and to geometrically confine the fabric by frictional forces.

In the process of the invention, the dryer drum 31 typically may be heated by high temperature steam. Thus, when the fabric 10, saturated with liquid ammonia at minus 33° C., comes into contact with the heated drum surface, the ammonia is almost instantly flashed off, to a level at which no further substantial reaction occurs, at least in terms of fabric shrinkage. Thus, the reaction period is effectively terminated almost instantly upon contact of the fabric with the heated drum.

Because of the impracticality, in a commercial operation, of varying the speed of an entire processing line from moment to moment, the process of the present invention comtemplates the provision of arrangements for controllably varying the length of the path through which the fabric travels, at constant speed, while it is saturated with reactable liquid ammonia. To this end, the movable axis guide rollers 28, 29, may be raised or lowered relative to the fixed rollers 26, 27. By bringing the rollers 28, 29 to positions most nearly in alignment with the rollers 26, 27, a fabric path of minimum length is provided between the fabric immersion point A and the terminal point B, at which the fabric contacts the heated drum. If it is desired to increase the reaction period, the rolls 28, 29 may be raised, causing the fabric to go through a more sinuous path, and thus increasing the time required to traverse the distance from A to B.

In accordance with one aspect of the invention, a fabric web 10 may be processed on a continuously controllable basis by establishing empirically a desired level of tension to be applied to the fabric in the warp direction by the tension control roller 25. When the processing is commenced, the tension control roller 25 is adjusted by the actuator means 33 to apply the desired pressure to the fabric, and the amount of such pressure is continuously sensed and monitored by a suitable sensing element 34, which may be of conventional, commercially available design. Should the pressure sensing element 34 reflect less than the desired level of pressure, indicating less than the desired level of warpwise tension, the position of the movable axis guide rollers 28, 29 is adjusted to increase the length of the fabric path between points A and B. This increases the duration of the reaction period slightly, permitting a slightly greater amount of lengthwise shrinkage to occur in the fabric and thereby tending to restore the desired level of fabric tension. Likewise, if the sensing element 34 detects excess warp tension in the fabric, the rollers 28, 29 are automatically lowered, shortening the reaction period and decreasing the resulting lengthwise shrinkage of the fabric until the desired level of warpwise fabric tension is restored.

In a continuous operation, moment-to-moment adjustments in the duration of the reaction period are desirably accomplished entirely by means of adjusting the position of the movable axis rollers 28, 29. In order to accommodate a wide variety of fabrics, however, provision is of course made for controlling the basic speed of operation of the entire line. Thus, the nominal reaction period may be established in the first instance by appropriately setting the speed of the entire processing line, thereby establishing a "nominal" time for the fabric travel between the initial and terminal points A, B in the treating chamber. The movable axis rolls are then adjusted to accommodate changes in either direction, from the nominal reaction period, so that the desired processing results are reliably achieved.

In the system shown in FIG. 1, there are two dryer stages 35, 36. In passing about the respective dryer drums 31, 37 of the dryer stages, the fabric 10 is tightly confined and pressed against the drum surface by tension maintained in the dryer blankets 32, 38, and most of the residual ammonia is driven out of the fabric. In this respect, although a substantial percentage of the ammonia is flashed off substantially instantly on contact of the fabric with the first dryer drum 31, causing the operative shrinkage reactions to substantially terminate, some residual ammonia remains entrapped in the interstices of the fabric, and a significant amount of the ammonia remains bonded with the cellulose. The fabric shows little if any tendency toward further ammonia-reaction shrinkage while traveling over the dryer stages 35, 36. Such shrinkage tendency is effectively restrained by the geometric stabilization provided by the confining blankets 32, 38.

Our experience indicates that not all of the residual ammonia-cellulose bonds can be thermally broken by the dryer stages 35, 36, at least within the realm of a practical commercial operation. Accordingly, the system of the invention desirably includes an isolated steaming chamber 39, which includes provisions for penetrating the fabric with steam. Typically, the residual ammonia bonds are easily broken in the presence of moisture, so that the fabric emerging from the steaming chamber is effectively free of residual ammonia. It will be understood, in this respect, that it is not vital from a processing standpoint to rid the fabric of the last vestiges of residual ammonia. However, gradual release of the residual ammonia from the finished fabric can result in a strong and unpleasant aroma in the finishing area. Thus, unless good ventilating facilities are available, it is usually desirable, as a practical matter, to remove as much of the ammonia as is practicable while the fabric remains within the closed processing chambers.

As reflected in FIG. 1, spent ammonia gases are extracted from the main chamber and are processed for recovery. The recovery procedure does not, however, form part of the present invention. Likewise, the ammonia gas-steam mixture from the steaming chamber 39 is extracted and either disposed of or processed for recovery as a low grade material.

Figure 2:
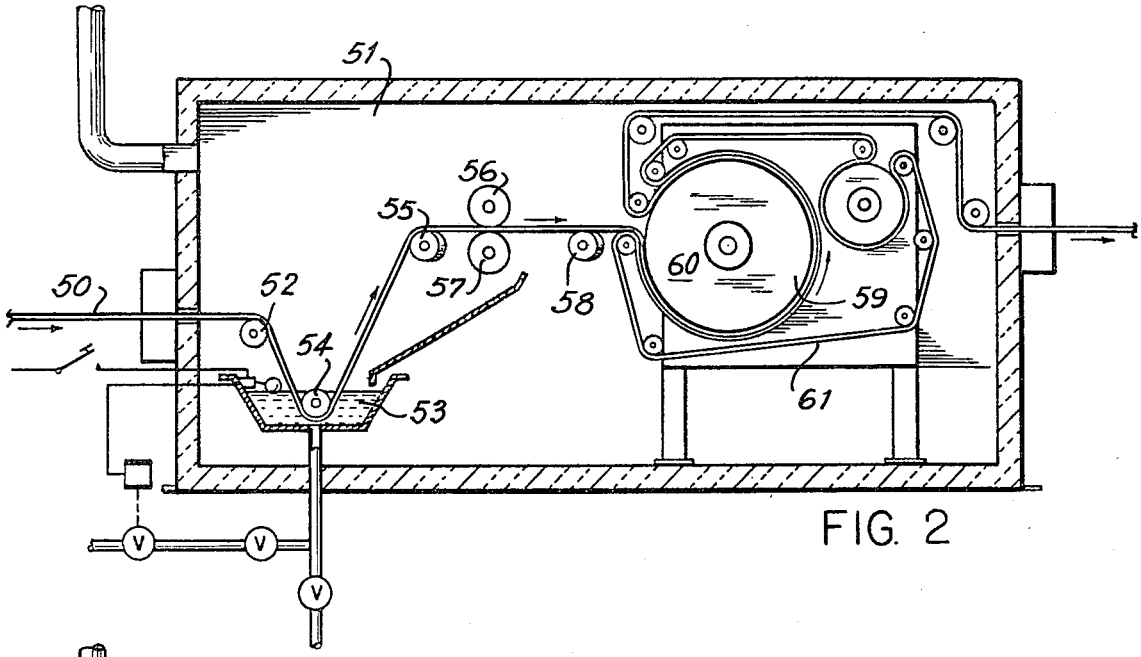
FIGS. 2 and 3 are simplified representations of modified arrangements for the processing of fabric according to the invention.
Figure 3:
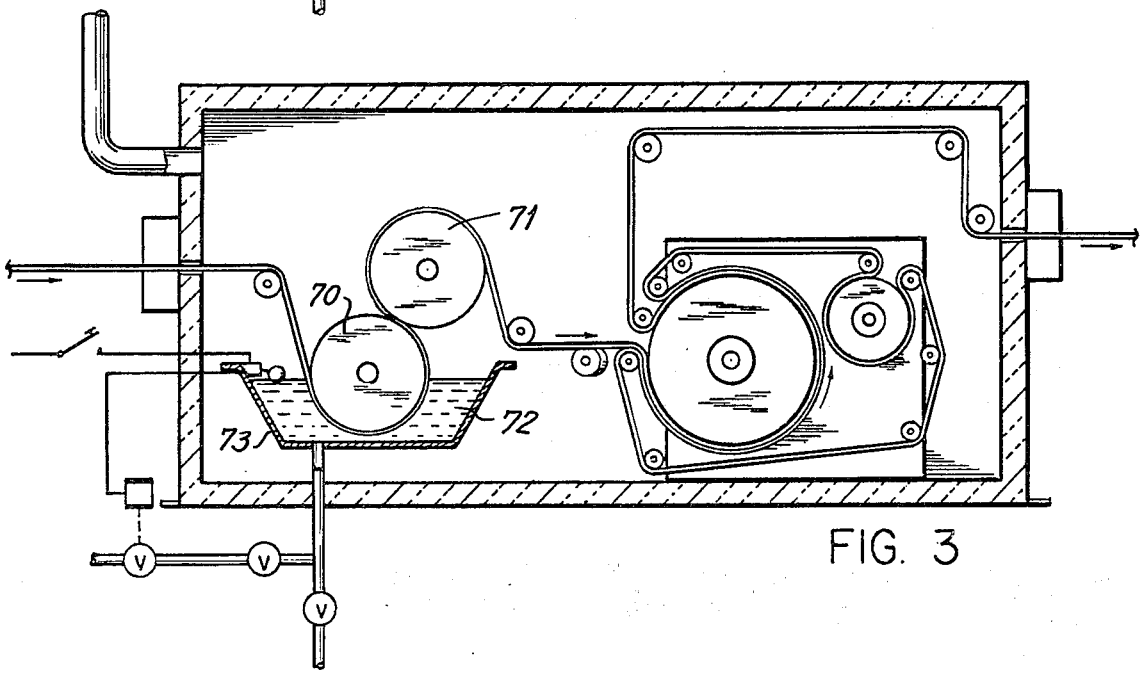

The processing systems illustrated schematically in FIGS. 2 and 3 are derived directly from our original parent application Ser. No. 106,514, filed Jan. 14, 1971. Each of these systems, while somewhat less sophisticated in terms of controls, is suitable for carrying out the basic processing steps of the invention. Thus, in the system of FIG. 2, fabric 50 enters an insulated processing chamber 51 and is directed around a first guide roller 52, downward into a bath 53 of substantially anhydrous liquid ammonia. The fabric then passes around a second guide roller 54 in the ammonia bath, thence upwardly around a first bowed roller 55, through a nip defined by a pair of resiliently covered pad rollers 56, 57, over a second bowed roller 58 and thence into direct contact with the heated drum 59 of a Palmer or other blanket type dryer stage 60.

As in the case of the system of FIG. 1, fabric processed by the system of FIG. 2 is thoroughly impregnated with liquid ammonia when it is immersed in the bath 53, and this ammonia is effectively reacting on the fabric until the fabric initially contacts the heated dryer drum 59. The initial, substantially instantaneous, flash off of the liquid ammonia upon contact with the dryer drum 59 effectively terminates the reaction period, at least insofar as significant shrinkage is concerned. Thereafter, the fabric passes around almost the entire circumference of the dryer drum 59, being held tightly thereagainst by the tensioned blanket 61. In the arrangement illustrated in FIG. 2, the blanket 61 itself advantageously passes around a heated drum 62, so that the blanket is at an elevated temperature when it initially contacts the ammonia-laden fabric.

In the system of FIG. 2, processing control is achieved almost entirely by controlling the speed at which the fabric 50 is conveyed through the processing chamber.

The processing system illustrated in FIG. 3 is generally similar to that illustrated in FIG. 2, except that a pair of pad rollers 70, 71 are arranged so that one of them, the lower roller 70, is partially submerged in the liquid ammonia bath 72 and serves as a guide roller for directing the fabric into and through the liquid ammonia bath. The pad rollers 70, 71 are so disposed that the fabric passes through the padding nip while traveling upwardly from the liquid ammonia bath 72. This achieves two results: first, the excess ammonia is removed as quickly as practicable and flows back to the retaining pan 73; secondly, the remaining liquid ammonia is uniformly distributed and thoroughly impregnated throughout the fabric at an early point in the reaction period, tending to assure greater uniformity in the processing results.

The arrangement of FIG. 3 may also be advantageous for use in connection with the processing of relatively sensitive materials, requiring processing times at the lower end of the range of reaction times contemplated by the invention. In this respect, the upper padding roll 71 may be in the form of a hollow drum, which is maintained at an elevated temperature, such that the liquid ammonia may, if desired, be partially or largely driven off as the fabric passes around the circumference of the roller. Thus, in some fabrics, by reducing the amount of the retained liquid ammonia to well below 50 percent of the dry weight of the fabric, for example, the reaction rate may be significantly slowed, at least as far as shrinkage is concerned. While theoretically this could be accomplished by merely applying a greater amount of rolling pressure at the pad roll nip, for many if not most fabrics, such pressures would be likely to damage the fiber structure. In a typical case, fabric saturated in the ammonia bath will pick up around, say, 130% of its weight of liquid ammonia. Some fabrics may absorb up to 200 to 300% of their weight in ammonia. In the padding nip, this typically will be reduced to a 100%, or even down, say, 70%. Removing more of the liquid ammonia by application of padding pressure could involve a danger of damaging the fibers of the fabric.

The process according to the invention is applicable to a wide variety of fabrics, incorporating a cellulosic fiber or content, and enables a wide variety of results to be achieved. The following Examples are illustrative but by no means limiting. In each of the Examples, the potential shrinkage of the untreated fabric has been determined by the CCC-T-191*a* method. The term "liquid ammonia take up" refers to the amount of shrinkage resulting from the ammonia processing. The term "treatment time" refers to the duration of the reaction period, as defined herein. Unless otherwise stated in the Example, Yarn Count is in the Cotton Count system. The term "treatment tension" refers to tension in the warp direction.

EXAMPLE 1

Fiber—Cotton; Yarn Count—Warp 7, Filling 6; Weight—14.0 oz/Y$^2$; Threads per inch—Warp 67, Filling 44; Treatment Time—8.0 seconds; Treatment Tension—8.0 ounces/inch; Liquid Ammonia Take-up—Warp 8.8%, Filling 4.2%; Potential Shrinkage of Untreated Fabric—Warp 15.7%, Filling 5.8%.

EXAMPLE 2

Fiber—Cotton; Yarn Count—Warp 7, Filling 10; Weight—12 oz/Y$^2$; Threads per inch—Warp 67, Filling 77; Treatment Time—6.0 seconds; Treatment Tension—8.0 ounces per inch; Liquid Ammonia Take-up—Warp 11.0%, Filling 1.8%; Potential Shrinkage of Untreated Fabric—Warp 15.6%, Filling 3.6%.

EXAMPLE 3

Fiber—Jute (Carpet Backing); Yarn Count—Warp (Jute) 15, Filling (Jute) 13; Weight—8.6 oz/Y$^2$; Threads per inch—Warp 16, Filling 14; Treatment Time—4.5 seconds; Treatment Tension—8.0 ounces-/inch; Liquid Ammonia Take-up—Warp 5.5%, Filling 4.8%; Potential Shrinkage of Untreated Fabric—Warp 8.0%, Filling 5.7%.

EXAMPLE 4

Fiber—Blended Fabric; Yarn Count—Warp (Denier) 31/1 50/50 Polyester Cotton, Filling (Denier) 1/150/34 100% Polyester; Weight—3.8 oz/Y$^2$; Threads per inch—Warp 80, Filling 64; Treatment Time—2.25 seconds; Treatment Tension—8.0 ounces per inch; Liquid Ammonia Take-up—Warp 4.9%, Filling 0.8%; Potential Shrinkage of Untreated Fabric—Warp 6.6%, Filling 2.1%.

EXAMPLE 5

Fiber—Cotton; Yarn Count—Warp 8/s (Singles), Filling 8/s (singles); Weight—10.9 oz/Y$^2$; Threads per inch—Warp 78, Filling 46; Treatment Time—3.0 seconds; Treatment Tension—2.0 ounces/inch; Liquid Ammonia Take-up—Warp 3.4%, Filling 4.2%; Potential Shrinkage of Untreated Fabric—Warp 4.8%, Filling 4.8%.

EXAMPLE 6

Fiber—Polyester/Cotton 15/85 (Knit); Yarn Count—Warp 24, Filling 24; Weight—4.3 oz/Y$^2$; Threads per inch—Courses 36, Wales 28; Treatment Time—0.5 seconds; Treatment Tension—2 ounces per inch; Liquid Ammonia Take-up—Warp 1.2+%, Filling 9.4%; Potential Shrinkage of Untreated Fabric—Warp 1.4%, Filling, 10.8%.

EXAMPLE 7

Fiber—Linen; Yarn Count—Warp (lea) 2.4, Filling (lea) 1.4; Weight—7.1 oz/Y$^2$; Threads per inch—Warp 38, Filling 24; Treatment Time—3.0 seconds; Treatment Tension—4.0 ounces; Liquid Ammonia Take-up—Warp 7.6%, Filling 5.5%; Potential Shrinkage of Untreated Fabric—Warp 13.2%, Filling 8.0%.

EXAMPLE 8

Fiber—Cotton; Yarn Count—Warp 7S (Singles), Filling 6S (Singles); Weight—14.8 oz/Y$^2$; Threads per inch—Warp 68, Filling 44; Treatment Time—6.0 seconds; Treatment Tension—8.0 ounces per inch; Liquid Ammonia Take-up—Warp 8.0%, Filling 4.5%; Potential Shrinkage of Untreated Fabric—Warp 13.3%, Filling 7.1%.

EXAMPLE 9

Fiber—Cotton (Corduroy); Yarn Count—Warp 16, Filling 20; Weight—9.1 oz/Y$^2$; Threads per inch—Warp 55, Filling 195; Treatment Time—4.5 seconds; Treatment Tension—4.0 ounces/inch; Liquid Ammonia Take-up—Warp 5.6%, Filling 3.0%; Potential Shrinkage of Untreated Fabric—Warp 7.3%, Filling 3.0+%.

EXAMPLE 10

Fiber—100% Viscose; Yarn Count—Warp 20S (Singles), Filling 20S (Singles); Weight—3.6 oz/Y$^2$; Threads per inch—Warp 54, Filling 50; Treatment Time—3.0 seconds; Treatment Tension—2.0 ounces per inch; Liquid Ammonia Take-up—Warp 3.6%, Filling 5.1%; Potential Shrinkage of Untreated Fabric—Warp 18.0%, Filling 7.8%.

EXAMPLE 11

Fiber—50/50 Polyester Viscose; Yarn Count—Warp 12-2 Ply, Filling 12-2 Ply; Weight—4.8 oz/Y$^2$; Threads per inch—Warp 82, Filling 49; Treatment Time—1.0 seconds; Treatment Tension—8.0 ounces/inch; Liquid Ammonia Take-up—Warp 0.8%, Filling 0.3%; Potential Shrinkage of Untreated Fabric—Warp 13.7%, Filling 2.1%.

EXAMPLE 12

Fiber—100% Cotton (Sport Denim); Yarn Count—Warp 8.3, Filling 12.2; Weight—8.86 oz/Y$^2$; Threads per inch—Warp 64, Filling 39; Treatment Time—1.5 seconds; Treatment Tension—8.0 ounces-/inch of width; Potential Shrinkage of Untreated Fabric—Warp 14.8%, Filling 6.6%; Liquid Ammonia Take-up—Warp 6.3%, Filling 4.2%.

EXAMPLE 13

Fiber—Cotton/Rayon (Sateen); Yarn Count—Warp 22, Filling 15; Weight—10.0 oz/Y$^2$; Threads per inch—Warp 113, Filling 59; Treatment Time—5.0 seconds; Treatment Tension—16 ounces/inch of width; Potential Shrinkage of Untreated Fabric—Warp 13.2%, Filling 1.2%; Liquid Ammonia Take-up—Warp 7.5 %. Filling 3.9%.

EXAMPLE 14

Fiber—100% Cotton (Denim); Yarn Count—Warp 7.8, Filling 10.4; Weight—10 oz/Y$^2$; Threads per inch—Warp 72, Filling 54; Treatment Time——6.0 seconds; Treatment Tension—4.0 ounces/inch of width;

Potential Shrinkage of Untreated Fabric—Warp 19.1%, Filling 7.5%; Liquid Ammonia Take-up—Warp 7.9%, Filling 4.5%.

EXAMPLE 15

Fiber—65/35 Linen/Polyester (Tablecloth); Yarn Count—Warp 7.5, Filling 7.2; Weight—6.55 oz/Y$^2$; Threads per inch—Warp 35, Filling 37; Treatment Time—6.0 seconds; Treatment Tension—8.0 ounces/inch of width; Potential Shrinkage of Untreated Fabric—Warp 9.5%, Filling 10.8%; Liquid Ammonia Take-up—Warp 6.0%, Filling 7.2%.

EXAMPLE 16

Fiber—100% Cotton (Corduroy); Yarn Count—Warp 19.2, Filling 13.4; Weight—9.56 oz/Y$^2$; Threads per inch—Warp 88, Filling 48; Treatment Time—6.0 seconds; Treatment Tension—8.0 ounces/inch of width; Potential Shrinkage of Untreated Fabric—Warp 7.6%, Filling 5% approx.; Liquid Ammonia Take-up—Warp 4.6%, Filling 2.1%.

EXAMPLE 17

Fiber—Rayon (Challis); Yarn Count—Warp 20 (Singles), Filling 20 (Singles); Weight—3.55 oz/Y$^2$; Threads per inch—Warp 54, Filling 50; Treatment Time—3.0 seconds; Treatment Tension—2.0 ounces/inch of width; Potential Shrinkage of Untreated Fabric—Warp 18.0%; Liquid Ammonia Take-up—Warp 3.6%, Filling 5.1%.

EXAMPLE 18

Fiber—100% Cotton (Twill); Yarn Count—Warp 20, Filling 16.4; Weight—7.5 oz/Y$^2$; Threads per inch—Warp 106, Filling 59; Treatment Time—1.0 seconds; Treatment Tension—8.0 ounces/inch of width; Potential Shrinkage of Untreated Fabric—Warp 8.3%, Filling 11.4%; Liquid Ammonia Take-up—Warp 6.8%, Filling 6.9%.

EXAMPLE 19

Fiber—65/35 Polyester/Cotton (Broadcloth); Yarn Count—Warp 37.5, Filling 37.5; Weight—3.2 oz/Y$^2$; Threads per inch—Warp 131, Filling 71; Treatment Time—0.75 seconds; Treatment Tension—8.0 ounces/inch of width; Potential Shrinkage of Untreated Fabric—Warp 7.5%, Filling 3.9%; Liquid Ammonia Take-up—Warp 2.4%, Filling 0.9%.

EXAMPLE 20

Fiber—50/50 Cotton/Rayon (Broadcloth); Yarn Count—Warp 22.5, Filling 21.0; Weight—4.5 oz/Y$^2$; Threads per inch—Warp 85, Filling 67; Treatment Time—1.0 seconds; Treatment Tension—0.8 ounces/inch of width; Potential Shrinkage of Untreated Fabric—Warp 7.4%, Filling 1.5+%; Liquid Ammonia Take-up—Warp 4.3%, Filling 3.6%.

EXAMPLE 21

Fiber—100% Cotton (Drill); Yarn Count—Warp 10.3, Filling 9.3; Weight—11.0 oz/Y$^2$; Threads per inch—Warp 88, Filling 45; Treatment Time—3.0 seconds; Treatment Tension—24 ounces/inch of width; Potential Shrinkage of Untreated Fabric—Warp 7.6%; Filling 3.0+%; Liquid Ammonia Take-up—Warp 7.5%, Filling 0%.

EXAMPLE 22

Fiber—Cotton; Yarn Count—Warp 34S (Singles), Filling 36S (Singles); Weight—4.4 oz/Y$^2$; Threads per inch—Warp 75, Filling 63; Treatment Time—1.0 seconds; Treatment Tension—4 ounces per inch; Liquid Ammonia Take-up—Warp 3.3%, Filling 3.0%; Potential Shrinkage of Untreated Fabric—Warp 6.2%, Filling 1.5+%.

The process of the invention constitutes a significant advance in the art of processing cellulosic-base fabrics with liquid ammonia. Many of the advantageous effects of liquid ammonia processing have been known for a long time, yet this form of processing has not heretofore achieved any measure of widespread commerical success. Essentially, this is because of the extreme shrinkage problem that is customarily experienced in the known procedures for carrying out liquid ammonia processing. A commercial processor simply cannot accept extraordinary losses in fabric area in the course of processing and still remain competitive.

In the past, it has been proposed to deal with the severe ammonia shrinkage problem through the application of tensions to the fabric. However, while it may be practicable to utilize tension methods in the handling of certain limited types of piece goods, it is not a practical approach for the production processing of continuous yard goods, because of the substantial impracticability of applying tension in an effective manner to the moving fabric web in the width direction during the ammonia reaction period. Tentering equipment is, of course, well known for applying width tension. However, tentering is not practicable for many fabrics and, under the best of circumstances, tentering can cause significant fabric distortion. By making the application of width tension unnecessary, the process of the invention permits the liquid ammonia treatment to be utilized on a commercially practicable scale.

In those special cases where the construction of the fabric and/or its prior processing are such as to make it difficult to leave residual width shrinkage after ammonia processing, such result may be achieved, if desired, by tentering prior to the ammonia processing, which is then carried out in the absence of width tension.

Our present invention is based in part on the discovery that shrinkage may be controlled effectively, at least in the width direction, by time alone. This discovery is premised on the observation that the majority of fabrics achieve effective mercerization by liquid ammonia treatment in an extremely short period of time, sometimes within a fraction of a second and in most cases less than 3 seconds. After this, continued exposure to and reaction with the liquid ammonia does not significantly improve mercerization but merely induces shrinkage in the length of the fiber. Thus, by controlling the reaction period in which the fabric is exposed to effective reaction by the liquid ammonia, the width shrinkage in a continuous web of fabric may be rather precisely controlled and limited. A maximum reaction period of nine seconds has been established to be an effective upper limit of the liquid ammonia reaction period for this purpose.

In this respect, it is of significance to the invention that the effective liquid ammonia reactions with the fabric be affirmatively and abruptly terminated within the desired treatment period in order to provide the necessary precision of control over the process.

It is deemed theoretically possible that practical means be developed for causing the normally rapid liquid ammonia reactions with the fabric to occur at a lower rate of speed. By way of example, this might be accomplished by precisely limiting the amount of liquid ammonia applied to the fabric. Insofar as the reaction rate between the liquid ammonia and the fabric may be slowed down by this or other means, certain of the basic principles of the invention would still be applicable as regards controlling the reaction period to achieve acceptable levels of mercerization while controllably terminating the reaction soon enough to avoid excessive shrinkage in the absence of width tension during the reaction period.

In the case of certain fabrics, among which corduroy is a notable example, the tendency for shrinkage in the filling direction of the fabric, as processed up to the stage of the liquid ammonia treatment, is so great, in relation to the residual washing shrinkage, that it is sometimes difficult to maintain the ammonia reaction shrinkage at a level appropriately less than the washing shrinkage potential. In such cases, it may be appropriate and desirable to enlarge the width of the fabric, as a preliminary treatment, so that the ammonia-processed fabric still retains some residual washing shrinkage in the width direction. The length direction is, of course, easily controlled during the reaction period itself through the application of tension in the warp direction. But in all cases, the liquid ammonia reactions are carried out while the fabric remains free of tension in the filling direction. In the treatment according to Example 16, as an illustration, the cotton corduroy material when otherwise ready for the liquid ammonia processing, had a residual washing shrinkage in the filling direction of only about 0.3%, making it difficult to impossible to retain some degree of washing shrinkage after the ammonia processing. Accordingly, in the instance of this example, the corduroy fabric was tentered prior to ammonia processing, increasing its width to provide for a potential shrinkage of around 5%. The ammonia processing resulted in approximately 2% take-up in the width direction, leaving a few percent of residual widthwise shrinkage after the ammonia treatment.

In some cases, of course, it may be either acceptable or affirmatively desirable to permit the width direction shrinkage from ammonia processing to exceed the residual washing shrinkage. And, while certain important aspects of the invention are directed to carrying out the process in a manner to provide residual washing shrinkage in the width direction, the invention is not exclusively directed thereto nor is it limited thereto. In the case of Examples 13 and 20, by way of illustration, rayon-based fabrics have been processed for a sufficient time to cause the ammonia reaction shrinkage in the width direction to exceed the residual washing shrinkage. This is sometimes desired in the case of rayon fabrics, in order to improve the hand and/or appearance of the fabric. In some cases, it is appropriate to combine such a treatment with a subsequent mechanical compacting of the fabric in the lengthwise direction.

Thus, it should be understood that the forms of the invention herein specifically illustrated and described are intended to be representative and not limiting, and the full scope of the invention is to be determined by reference to the appended claims.

We claim:

1. The process of continuously treating with liquid ammonia a fabric web, formed in significant part of natural or regenerated cellulose, characterized by a. continuously advancing a web of the fabric to and through a treating zone, b. commencing a treating reaction within the treating zone by progressively impregnating the advancing fabric with liquid ammonia, c. maintaining the advancing fabric in contact with the liquid ammonia for a predetermined reaction period, commencing with the initial impregnation of the fabric, d. terminating the effective reaction period by, within 0.6 to 9 seconds of the commencement thereof, commencing and continuing the rapid removal of the liquid ammonia from said fabric, and e. thereafter conveying the fabric web from said treatment zone.

2. A process according to claim 1, further characterized by a. said fabric web, during said reaction period, being substantially free of widthwise tension, b. the effective duration of said reaction period being such that width shrinkage of the web during treatment is limited to a controlled, predetermined amount, and c. the length shrinkage of said web during treatment being controlled and limited by, in addition to limitations imposed by the limited duration of the effective reaction period, maintaining a controlled amount of lengthwise tension on said web as it traverses the treatment zone.

3. A process according to claim 1, further characterized by a. rapid removal of the liquid ammonia being commenced and continued by conveying said web into direct contact with a heated surface and maintaining said web in pressure contacting relation with said heated surface for a time to eliminate at least the highly reactive liquid phase of the ammonia from the fabric web.

4. A process according to claim 3, further characterized by a. said fabric web, after said quick removal step, being exposed to a high moisture environment to facilitate displacement from the fabric of residual ammonia.

5. A process according to claim 1, further characterized by a. during the period of rapid removal of at least the liquid phase of the ammonia from said fabric, said fabric being geometrically confined against a surface.

6. A process according to claim 5, further characterized by a. the rapid removal of liquid ammonia being effected by bringing said fabric web into contact with the surface of a synchronously rotating dryer drum, and b. the fabric being simultaneously confined geometrically and held in contact with said drum by means of a confining blanket moving synchronously with said drum.

7. A process according to claim 1, further characterized by a. said fabric being initially thoroughly wet out by the liquid ammonia, b. quickly thereafter subjecting the wet-out fabric to controlled rolling pressure to effect thorough and uniform penetration of the fabric by said liquid ammonia and to remove excess amount of said liquid ammonia, and thereafter commencing said rapid removal.

8. A process according to claim 7, further characterized by a. said fabric being initially wet-out by direct immersion of the fabric in a confined body of liquid ammonia.

9. The process of continuously treating with liquid ammonia a fabric web, formed in significant part of natural or regenerated cellulose, which comprises a. progressively delivering a web of the fabric in a substantially dry state, b. impregnating said fabric in a treating zone with a sufficient amount of substantially anhydrous liquid ammonia to effect rapid mercerization of said fabric and to commence shrinkage thereof in the absence of counteracting tension, c. subsequent to substantial impregnation of said fabric web and prior to excessive shrinkage thereof, and within a period of from 0.6 seconds to 9 seconds from impregnation of the fabric, effectively terminating the liquid ammonia reaction with the fabric.

10. The process of claim 9, further characterized by a. the combined moisture content of said substantially dry fabric and of said substantially anhydrous ammonia being not substantially more than about 10% of the weight of the ammonia with which the fabric is impregnated.

11. The process of claim 10, further characterized by a. said fabric being heated prior to impregnation to reduce its moisture content, and b. said heated fabric being cooled prior to impregnation.

12. The process of claim 9, further characterized by a. said fabric web being conveyed, during its period of reaction with said liquid ammonia, substantially free of tension in the width direction.

13. The process of claim 9, further characterized by a. said liquid ammonia reactions being effectively terminated at a time, within 9 seconds of impregnation at which width direction shrinkage of the web is equal to or less than the washing shrinkage of the fabric in such direction.

14. The process of claim 13, further characterized by a. during said reaction period, shrinkage of the fabric in the warp direction is limited to an amount equal to or less than the washing shrinkage by the controlled application of tension in the warp direction.

15. The process of claim 9, further characterized by a. said ammonia reactions being effectively terminated by bringing said web into full surface pressure contact with a synchronously moving heated surface.

16. The process of claim 15, further characterized by a. said fabric is maintained in continued contact with said heated surface for a period, subsequent to the termination of said reaction period, to drive off residual ammonia from the fabric.

17. The process of claim 16, further characterized by a. said fabric, subsequent to said continued contact, is exposed to a moisterizing medium to facilitate the further release of bonded ammonia.

18. The process of continuously treating with liquid ammonia a moving web of fabric, formed in significant part of natural or regenerated cellulose, which comprises a. progressively conveying the fabric web through a treating zone, b. impregnating the fabric in said zone with liquid ammonia, c. causing or permitting the liquid ammonia to react with the fabric in said zone for a period sufficient to achieve commerically acceptable levels of mercerization of the fabric, and d. thereafter effectively terminating the liquid ammonia reaction before said fabric web has been shrunk in the width direction by an amount as great as its washing shrinkage, e. said fabric being maintained substantially free of tension in the width direction during the period of said liquid ammonia reaction.

19. The process of claim 18, further characterized by a. said fabric being maintained under sufficient lengthwise tension during the period of said liquid ammonia reaction to prevent shrinkage of the fabric in a lengthwise direction in amounts exceeding the washing shrinkage of the fabric in such direction.

20. The process of claim 19, further characterized by a. the combined water content of the fabric and the liquid ammonia being not substantially in excess of ten percent of the weight of the ammonia with which the fabric is impregnated.

21. The process of claim 20, further characterized by a. said fabric being treated prior to liquid ammonia impregnation to reduce its moisture content and again after the liquid ammonia reaction to increase its moisture content.

22. The process of claim 18, further characterized by a. said liquid ammonia reaction being effectively terminated by bringing the fabric web progressively into contact with a heated surface, and b. urging the fabric into pressure contact with said surface and maintaining such pressure contact for a period sufficient to drive off substantial amounts of the residual ammonia.

23. The process of claim 22, further characterized by a. said heated surface comprising a rotating drum, and b. said fabric being maintained in pressure contact with said surface over the entire width of the fabric and over a substantial circumferential area of the drum by means of a tensioned blanket moving with the drum.

24. The process of claim 18, further characterized by a. prior to impregnating the fabric with liquid ammonia, expanding the fabric in the width direction to increase its widthwise shrinkage potential.

25. The process of claim 24, further characterized by a. said fabric being a cotton corduroy.

26. The process of claim 18, further characterized by a. said liquid ammonia reaction being effectively terminated within 0.6 to 9 seconds after impregnation of the fabric.

* * * * *